US005297728A

United States Patent [19]

Yano et al.

[11] Patent Number: 5,297,728

[45] Date of Patent: Mar. 29, 1994

[54] THERMAL EXPANSION VALVE

[75] Inventors: Masamichi Yano, Tokyo; Kazuhiko Watanabe, Sagamihara; Tetsurou Ikoma, Kawasaki, all of Japan

[73] Assignee: Fuji Koki Manufacturing Co., Ltd., Tokyo, Japan

[21] Appl. No.: 967,338

[22] Filed: Oct. 28, 1992

[30] Foreign Application Priority Data

Mar. 11, 1992 [JP] Japan ..... 4-52677

[51] Int. Cl.[5] ..... F25B 41/04

[52] U.S. Cl. ..... 236/92 B; 62/225

[58] Field of Search ..... 62/225, 224, 210, 212, 62/214, 222; 236/96 B

[56] References Cited

U.S. PATENT DOCUMENTS 2,011,379 8/1935 Smith .
3,537,645 11/1970 Treder ..... 236/92
3,817,053 6/1974 Orth ..... 62/225
4,065,939 1/1978 Thornberg et al. ..... 236/92 B
4,979,372 12/1990 Tanaka ..... 236/92 B
5,127,237 7/1992 Sendo et al. ..... 236/92 B

FOREIGN PATENT DOCUMENTS 59-027321 6/1984 Japan .

*Primary Examiner*—Harry B. Tanner
*Attorney, Agent, or Firm*—Kenyon & Kenyon

[57] ABSTRACT

A thermal expansion valve drives a valve body in a housing through a driving member by a gas pressure of a heat sensitive working fluid sealed in a power element, neighboring the housing, by a diaphragm. The driving member holds a heat ballast at its blind hole opened to the working fluid. A diaphragm has a center opening surrounded by a tubular projection, the diaphragm side end portion of the driving member is inserted in the opening, and a diaphragm catch is fitted on the outer periphery of the projection. The catch, the extended end of the projection and the end of the driving member are airtightly welded to each other.

6 Claims, 4 Drawing Sheets

THERMAL EXPANSION VALVE

BACKGROUND OF THE INVENTION

1. Field of the Invention

This invention relates to a thermal expansion valve and, more particularly, to a thermal expansion valve combined with a thermal bulb.

2. Description of the Related Art

A thermal expansion valve is used together with a compressor, a condenser and an evaporator in a refrigeration apparatus using a refrigerant, and controls the flow rate of the refrigerant flowing into the evaporator in response to the temperature of the refrigerant at an outlet port of the evaporator.

A typical thermal expansion valve comprises: a thermal bulb in which a heat sensitive working fluid is sealed and which is located at the outlet of the evaporator and produces a pressure of a gas of the working fluid in response to the temperature of the refrigerant at the outlet port of the evaporator; a power element which has a diaphragm and which communicates with the thermal bulb by a capillary tube and which activates the diaphragm in response to the pressure of the gas of the working fluid in the thermal bulb; and a valve housing which is adjacent to and combined with the power element, in which two independent refrigerant flow passages are provided, and which holds a valve body to move relative to a valve seat formed in one refrigerant flow passage and which also holds a valve body drive member for transmitting a deflection of the diaphragm of the power element to the valve body to make it sit on and separate from the valve seat in response to the deflection of the diaphragm (that is, the temperature of the refrigerant at the outlet port of the evaporator).

When the conventional thermal expansion valve having such a configuration as described above is used for an air conditioner of an automobile, particularly for a compact car, it is troublesome to install the long and fine capillary tube in a small engine room, and the capillary tube is liable to be damaged under maintenance and repair work in the engine room.

For these reasons, the power element and the thermal bulb are combined with each other in a thermal expansion valve of an automobile air conditioner, and this thermal expansion valve does not use a capillary tube. FIG. 3 shows a longitudinal sectional view of the conventional thermal expansion valve of the automobile air conditioner.

In a valve housing 10 of the thermal expansion valve, a first refrigerant passage 14 and a second refrigerant passage 16 are formed independently from each other, and a valve seat 12 is formed in the first refrigerant passage 14. One end of the first refrigerant passage 14 is connected to an inlet port of an evaporator; an outlet port of the evaporator is connected to the other end of the first refrigerant passage 14 by way of the second refrigerant passage 16, a compressor, a condenser and a reservoir.

A valve body 18 is disposed in the first refrigerant passage 14 and is urged to sit on the valve seat 12 by urging means 17. A power element 20 having a diaphragm 19 is fixed to the valve housing 10 and is disposed adjacent to the second refrigerant passage 16. One chamber **20*a* partitioned by the diaphragm 19 in the power element 20** is airtightly sealed and contains a heat sensitive working fluid used in a conventional thermal bulb.

A short capillary tube 21 extending from the sealed chamber **20*a* of the power element 20 is used to degas from or inject the heat sensitive working fluid into the chamber 20*a*, and the extended end of the tube 21** is airtightly sealed after the completion of degassing and injection.

In another chamber **20*b* of the power element 20, an extended end of a valve body drive member 22 extending from the valve body 18 through the second refrigerant passage 16 in the valve housing 10 is disposed and abuts the diaphragm 19. The valve body drive member 22 is made of a material having a large heat capacity and transmits heat of a vapor of the refrigerant, flowing out from the outlet port of the evaporator and flowing into the second refrigerant passage 16, to the heat sensitive working fluid in the sealed chamber 20*a* of the power element 20, so that the working fluid provides a working gas having a pressure in response to a temperature of the vapor of the refrigerant. The other chamber 20*b* communicates with the second refrigerant passage 16 within the valve housing 10 by way of a peripheral gap of the valve body drive member 22**.

Thus, under the influence of the urging force of the urging means 17, the diaphragm 19 of the power element 20 controls the degree of the opening of the valve body 18 relative to the valve seat 12 (that is the flow rate of the liquid refrigerant flowing into the inlet port of the evaporator) in response to the difference between the pressure of the gas of the heat sensitive working fluid in the sealed chamber **20*a* of the power element 20 and that of the refrigerant vapor in the other chamber 20*b*** or in the outlet port of the evaporator (it is considered that the pressure difference is in proportion to the degree of superheat defined by a difference between the temperature of the refrigerant vapor at the outlet port of the evaporator and that of evaporation of the refrigerant in the evaporator).

This conventional combined type thermal expansion valve can be easily installed in the air conditioner of an automobile, particularly a compact car. But, since the sealed chamber **20*a* of the power element 20 projects into the space of the engine room, the heat sensitive working fluid in the sealed chamber 20*a* is influenced by not only the temperature of the refrigerant vapor at the outlet port of the evaporator, transmitted through the valve body drive member 22**, but also the temperature of the atmosphere in the engine room.

Therefore, the thermal expansion valve influenced by the atmosphere can not fully work its function.

FIG. 4 shows a thermal expansion valve proposed in U.S. Pat. No. 3,537,645 and improved to eliminate the above disadvantages of the above described conventional thermal expansion valve.

The same components of the improved thermal expansion valve of FIG. 4 as those of the valve of FIG. 3 are indicated by the same reference numerals as those of FIG. 3, and their detailed description will be omitted here.

In the improved conventional thermal expansion valve, an end portion of the valve body drive member 22 located adjacent to the diaphragm 19 is inserted into an opening formed in a center of the diaphragm 19 and is firmly fixed to the central opening of the diaphragm 19. A blind hole **22*a* is bored in an end surface of the end portion of the valve body drive member 22 to open to the sealed chamber 20*a* of the power element 20. Since the heat sensitive working fluid in the sealed chamber 20a of the power element 20 can flow into and flow out from the blind hole 22a of the valve body drive member 22**, the working fluid functions more in response to the temperature of the refrigerant vapor at the outlet port of the evaporator than in response to the temperature of the atmosphere in the engine room.

The improved conventional thermal expansion valve, however, is too sensitive to and excessively responsive to the temperature of the refrigerant vapor at the outlet port of the evaporator, so that it makes the valve body 18 frequently move between open and closed positions (a "hunting" phenomenon). Such a phenomenon makes the performance of the air conditioner unstable and significantly reduces its efficiency.

Further, in the improved conventional thermal expansion valve shown in FIG. 4, achieving an airtight sealing at the fixing between the central opening of the diaphragm 19 and the corresponding end of the valve body drive member 22 results in a troublesome reduction in the durability of the diaphragm 19.

FIG. 5 shows an enlarged view of the fixing between the central opening of the diaphragm 19 and the corresponding end of the valve body drive member 22. A step is formed in the outer peripheral surface of the end portion of the valve body drive member 22. A diaphragm support member 22b is stacked on the step, and the peripheral portion of the central opening of the diaphragm 19 and a diaphragm catch 22c are placed successively on the diaphragm support member 22b, and an airtight sealing of the central opening of the diaphragm 19 is produced by welding a peripheral edge 22d of the diaphragm catch 22c to the surface of the diaphragm 19.

If the welding is carried out sufficiently to ensure an airtight seal, the inner peripheral edge of the thin diaphragm 19 surrounding the central opening tends to become brittle by heat due to the welding. Consequently, the inner peripheral edge of the diaphragm 19 surrounding the central opening is fatigued and is broken easily after a relatively small number of deflections in operation.

The improved conventional thermal expansion valve as described above is, therefore, still defective in terms of durability, and such thermal expansion valves are not actually used.

SUMMARY OF THE INVENTION

This invention is contrived from the above circumstances, and therefore an object of the present invention is to provide a thermal expansion valve which does not use a capillary tube but rather a power element and a thermal bulb combined with each other so that the thermal expansion valve can be easily installed in a narrow space, such as an engine room of an automobile. Another object of the present invention is to provide a thermal expansion valve which does not generate any hunting phenomenon so that an air conditioner using the thermal expansion valve of this invention can operate stably and increase its operating efficiency. Another object of the present invention is to provide a thermal expansion valve which can work for a long period of time without causing any breakage of the diaphragm.

The above described objects of the present invention are achieved by providing a thermal expansion valve comprising a valve housing, a valve body, valve body urging means, a power element, a valve body drive member and a heat ballast, having features as follows. The valve housing comprises a first refrigerant passage, having a valve seat and adapted to communicate with a refrigerant inlet port of an evaporator, and a second refrigerant passage, independent from the first refrigerant passage and adapted to communicate with a refrigerant outlet port of the evaporator. The valve body is disposed in the valve housing to freely sit on and separate from the valve seat, and the valve body urging means urges the valve body toward the valve seat in the valve housing. The power element is disposed adjacent to the valve housing and has a diaphragm partitioning an inner space of the power element into a heat sensitive working chamber and a refrigerant vapor working chamber, the heat sensitive working chamber holding a heat sensitive working fluid in a sealed manner and the refrigerant vapor working chamber being independent of the heat sensitive working chamber and communicating with the second refrigerant passage. The valve body drive member is fixed to the center of the diaphragm of the power element, is exposed to the second refrigerant passage, has a blind hole open to the heat sensitive working chamber of the power element, and transmits a deflection of the diaphragm to the valve body to make the valve body sit on and separate from the valve seat. The heat ballast is contained in the blind hole of the valve body drive member and retards at least the rate of gas pressure rise of the heat sensitive working fluid in the heat sensitive working chamber, caused by the temperature rise of the refrigerant vapor flowing in the second refrigerant passage at the refrigerant outlet port of the evaporator. A central opening for receiving an end portion of the valve body drive member is formed in a center of the diaphragm, and an inner peripheral portion of the diaphragm surrounding the central opening forms a tubular projection which extends along an outer peripheral surface of the end portion of the valve body drive member inserted into the central opening of the diaphragm and toward an end of the end portion. An annular diaphragm catch is fitted on an outer peripheral surface of the tubular projection of the diaphragm. A projecting end of the tubular projection of the diaphragm, the end of the end portion of the valve body drive member and an end surface of the diaphragm catch at the side of the projecting end of the tubular projection of the diaphragm are airtightly welded together.

In the thermal expansion valve constructed as described above in accordance with the present invention, the power element holding the heat sensitive working fluid in its heat sensitive working chamber and functioning as a thermal bulb and the valve housing are disposed adjacent to each other, and the thermal expansion valve has no capillary tube, so that the thermal expansion valve can be easily installed in a narrow space such as an automobile engine room.

Additionally, since the heat ballast contained in the blind hole of the valve body drive member retards at least the rate of gas pressure rise of the heat sensitive working fluid in the heat sensitive working chamber caused by the temperature rise of the refrigerant vapor flowing in the second refrigerant passage at the refrigerant outlet port of the evaporator and suppresses the hunting phenomenon, the air conditioner operates stably, and the working efficiency of the air conditioner can be increased.

Finally, since the projecting end of the tubular projection surrounding the central opening of the diaphragm which is airtightly welded to the valve body drive member and the diaphragm catch is far away from a diaphragm main portion which extends radially outwardly from the central opening of the diaphragm, the diaphragm main portion is not adversely affected by heat generated from the welding. Thus, the diaphragm is free from any heat fatigue, and the thermal expansion valve can be used for a long period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Now, a thermal expansion valve according to one embodiment of the present invention will be described in detail with reference to FIGS. 1 and 2 of the accompanying drawings.

Figure 3:
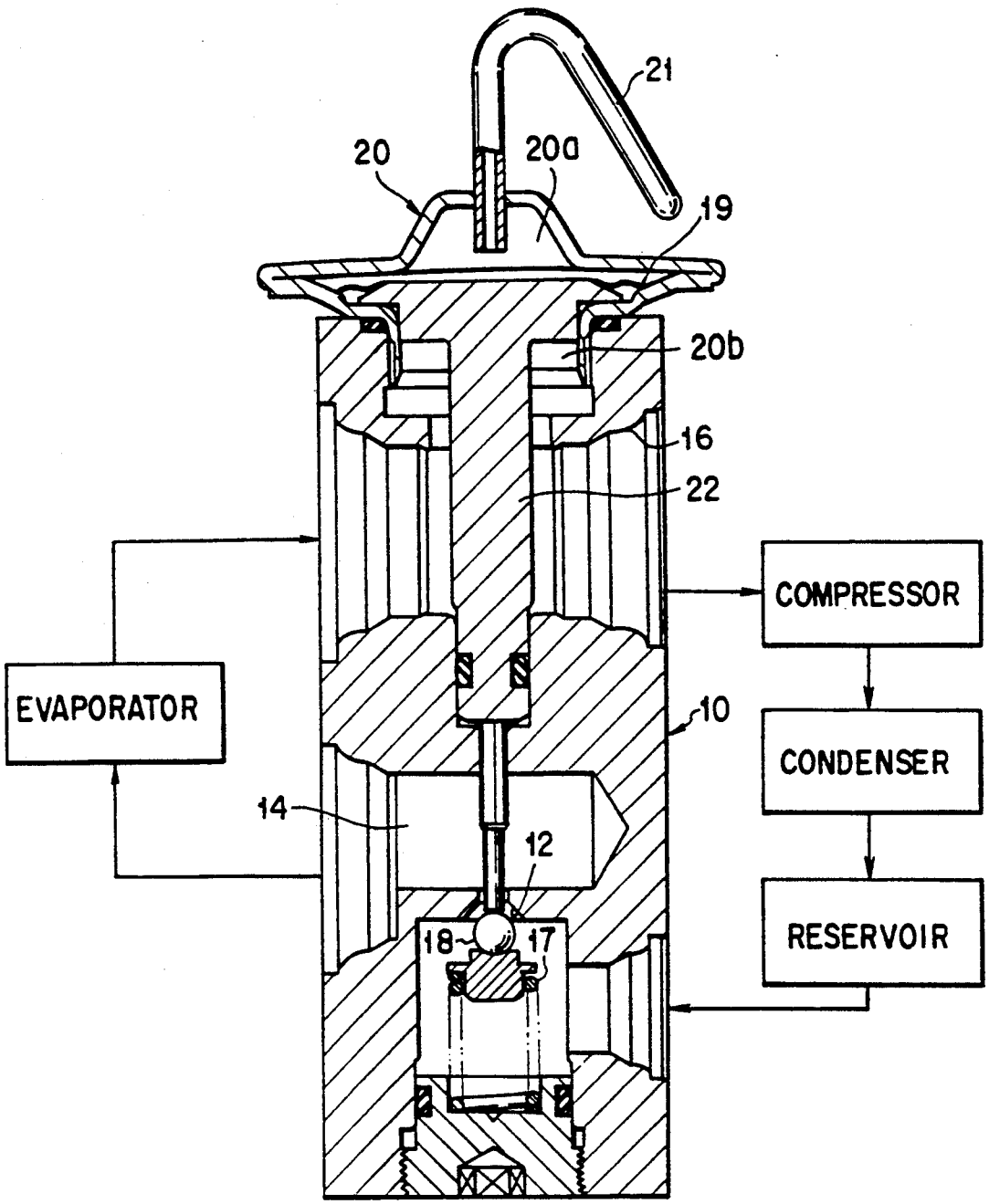
PRIOR ART F I G. 3
FIG. 3 is a longitudinal sectional view of a conventional thermal expansion valve.
Figure 4:
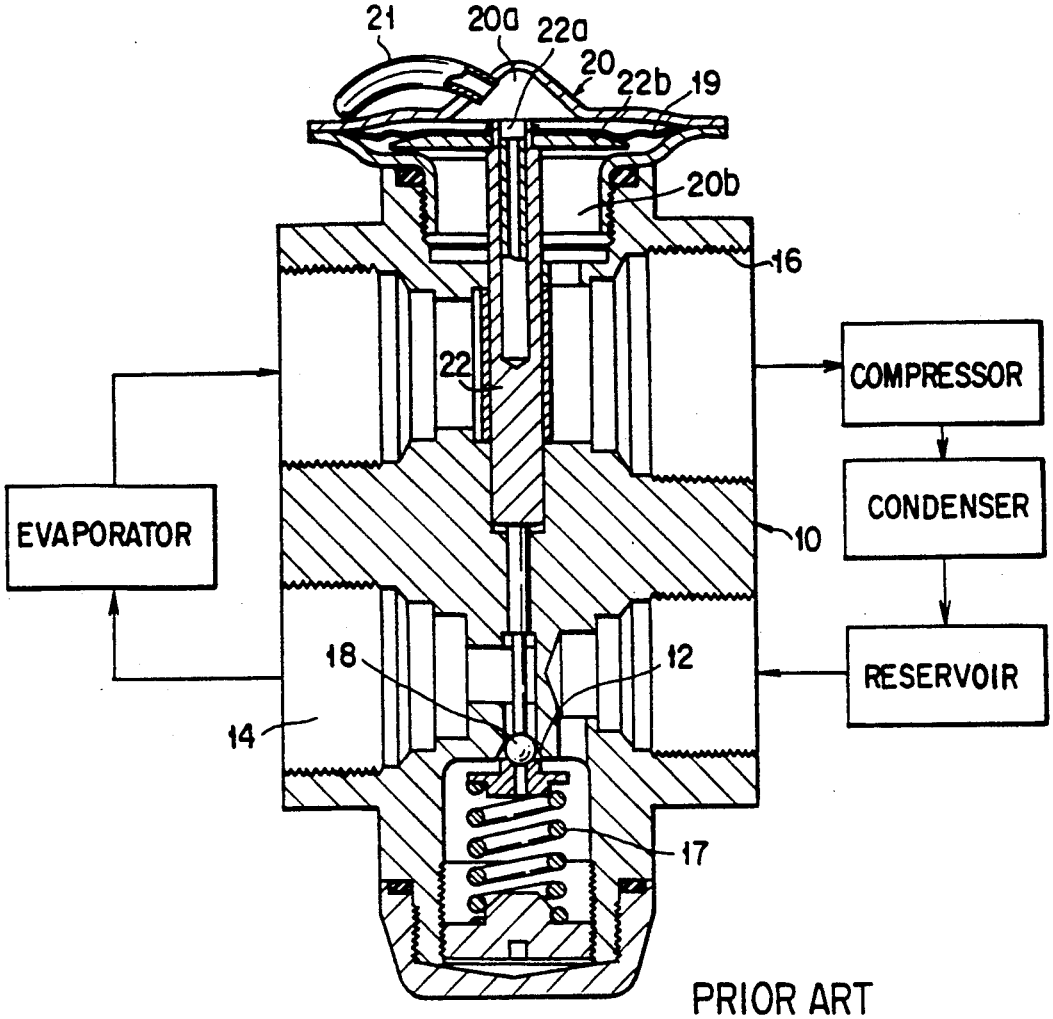
PRIOR ART FIG. 4
FIG. 4 is a longitudinal sectional view of an improved conventional thermal expansion valve, which is not used actually.
Figure 5:
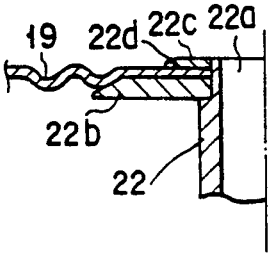
PRIOR ART FIG. 5
FIG. 5 is an enlarged longitudinal sectional view showing a fixing construction between a central opening of a diaphragm and an outer peripheral surface of an end portion of a valve body drive member by an airtight welding in the thermal expansion valve of FIG. 4.

The same components of the embodiment as those of the conventional thermal expansion valves shown in FIGS. 3 and 4 are indicated by the same reference numerals as those of their counterparts in FIGS. 3 and 4 and will not be described in detail.

Figure 1:
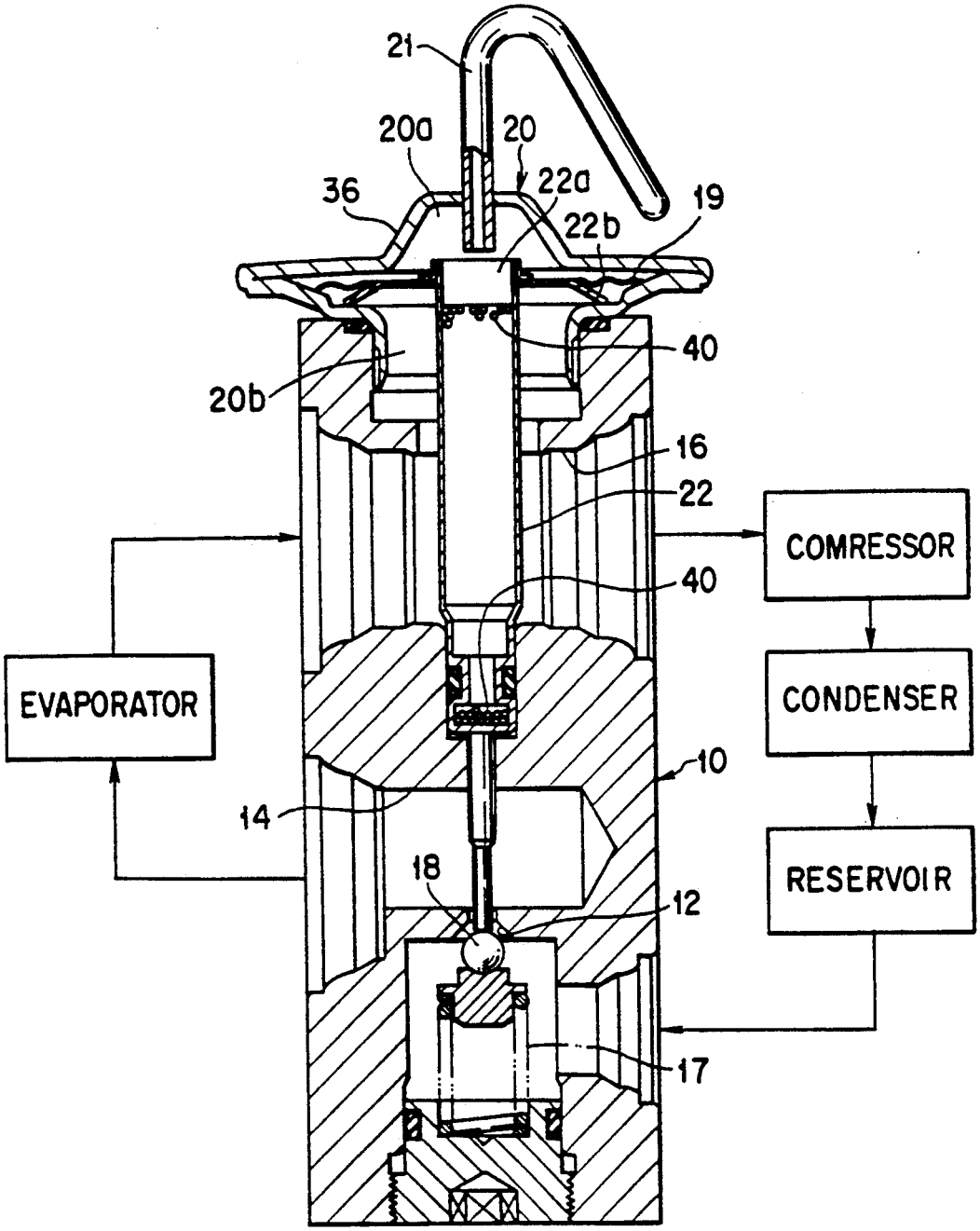
FIG. 1 is a longitudinal sectional view of a thermal expansion valve according to one embodiment of the invention.

Note that the embodiment of FIG. 1 is different from the conventional thermal expansion valve of FIG. 4 only in the fixing construction between the central opening of the diaphragm 19 and the outer peripheral surface of the end portion of the valve body drive member 22 by the sealing welding, and the rest of the embodiment is basically the same as that of the thermal expansion valve of FIG. 4.

Figure 2:
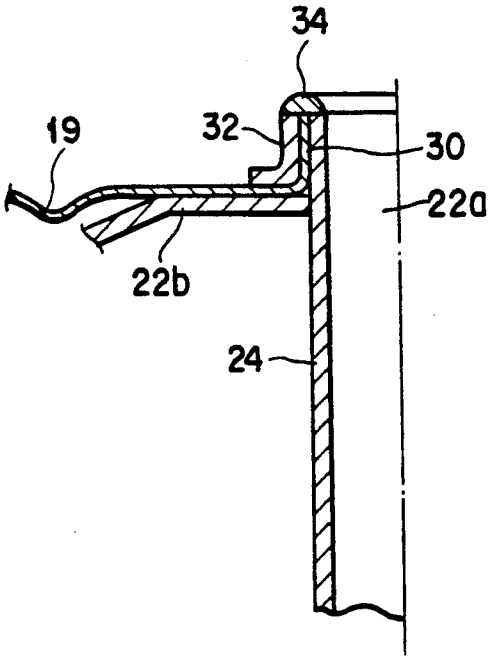
FIG. 2 is an enlarged longitudinal sectional view showing a fixing construction between a central opening of a diaphragm and an outer peripheral surface of an end portion of a valve body drive member by an airtight welding in the thermal expansion valve of FIG. 1.

As particularly shown in FIG. 2, an inner peripheral portion of the diaphragm 19 surrounding the central opening for receiving a diaphragm side end portion of the valve body drive member 22 forms a tubular projection 30 which extends along the outer peripheral surface of the end portion of the valve body drive member 22 toward the end surface of the end portion. The tubular projection 30 has an inner diameter substantially equal to the outer diameter of the end portion of the valve body drive member 22, and the tubular projection 30 of the diaphragm 19 is fitted on the outer peripheral surface of the end portion of the valve body drive member 22 until the diaphragm 19 abuts on the diaphragm support member **22*b*. Further, an annular diaphragm catch 32 having a substantially L-shaped cross section is fitted on the outer peripheral surface of the tubular projection 30. The diaphragm catch 32 has an inner diameter substantially equal to the outer diameter of the tubular projection 30, and its radially extending portion makes the circumferential region of the diaphragm 19 surrounding the base end of the tubular projection 30 closely fit on the diaphragm support member 22*b***.

The projecting end of the tubular projection 30 of the diaphragm 19, the end surface of the above described end portion of the valve body drive member 22 and an extended end of a longitudinally extending portion of the diaphragm catch 32 are arranged in a same height level and are airtightly fixed to each other by a welding bead 34.

The heat applied to the projecting end of the tubular projection 30 by the welding does not adversely affect a main portion of the diaphragm 19 which is radially outwardly arranged from the base end of the tubular projection 30. Therefore, the thermal expansion valve can enjoy a long service life without breakage of the diaphragm 19.

In this embodiment, a housing 36 (FIG. 1) of the power element 20 and the diaphragm 19 are made of a stainless steel defined as SUS304 by JIS (Japanese Industrial Standard), and the tubular projection 30 of the diaphragm 19 has a height of approximately 1.5 mm.

A heat ballast 40 such as particulate active carbon or sintered alumina silica is contained in the blind hold **22*a* bored in the end surface of the end portion of the valve body drive member 22**.

$CF_4$ (tetrafluoromethane) is used as the heat sensitive working fluid sealed in the chamber **20*a* of the power element 20 when particle active carbon is used as the heat ballast 40, and $CF_3$—$CH_2F$ (1,1,2-tetrafluoroethane). a common refrigerant, is used as the heat sensitive working fluid when sintered alumina silica is used as the heat ballast 40**.

A combination of the heat sensitive working fluid of $CF_4$ (tetrafluoromethane) and the heat ballast 40 of the active carbon is an adsorption equilibrium type, and a pressure generated from the combination can be approximated by a linear expression of temperature over a considerably wide temperature range. Since a coefficient of the linear expression can be set to a desired value by appropriately determining the volume of the particulate active carbon to be sealed, the user of the thermal expansion valve can set desirably the performance of the thermal expansion valve.

A considerable period of time is required to set a pressure-temperature equilibrium in the adsorption equilibrium type both when the temperature of the refrigerant vapor flowing out of the outlet port of the evaporator is rising (and the degree of superheat is rising) and when that temperature is falling (and the degree of superheat is falling). This suppresses the excessively sensitive action of the thermal expansion valve to ensure a stable operation of the air conditioner and consequently to increase its operating efficiency.

Alternatively, sintered alumina silica and $CF_3$—$CH_2F$ (1,1,1,2- tetrafluoroethane), a common refrigerant, may be respectively used for the heat ballast 40 and the heat sensitive working fluid sealed in the chamber 20a of the power element 20.

A combination of the heat ballast 40 of sintered alumina silica and the heat sensitive working fluid of $CF_3$—$CH_2F$ (1,1,1,2- tetrafluoroethane) is a gas-liquid equilibrium type. With such a combination, since the heat sensitive working fluid is entered into fine pores of the heat ballast 40, the transition from a liquid phase to a gas phase (gasification) of the heat sensitive working fluid is retarded when the temperature of the refrigerant vapor flowing out of the outlet port of the evaporator is rising (the degree of superheat is rising). And a rapid transition from a gas phase to a liquid phase (liquefaction) of the working gas in the chamber 20a and the blind hole 22a other than the gas in the fine pores of the heat ballast 40 is not hindered on the wall surfaces of the chamber 20a and the blind hole 22a. In other words, the flow rate of the refrigerant flowing through the valve seat and into the inlet port of the evaporator is raised gradually when the degree of superheat is rising, and it is lowered rapidly when the degree of superheat is falling. Thus, an air conditioner using the thermal expansion valve of the gas-liquid equilibrium type has a higher cooling capacity than that of the adsorption equilibrium type during a certain period of time immediately after the start of operation. Moreover, after reaching a stabilized stage of operation, the thermal expansion valve of the gas-liquid equilibrium type is prevented from excessively sensitive acting caused by the influence of disturbance, so that the air conditioner can stably operate and consequently its operating efficiency is higher as in the case of that of the adsorption equilibrium type.

In the above embodiment, the base end of the tubular projection 30 of the diaphragm 19 is staked on the diaphragm support member 22b fixed on the peripheral surface of the end portion of the valve body drive member 22. The base portion, however, does not necessarily need to be stacked on the diaphragm support member 22b; it may be supported by a step formed on the outer peripheral surface of the end portion of the valve body drive member 22 that operates as the support 22b for the diaphragm 19.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A thermal expansion valve comprising:

a valve housing in which a first refrigerant passage, having a valve seat and adapted to communicate with a refrigerant inlet port of an evaporator, and a second refrigerant passage, independent from the first refrigerant passage and adapted to communicate with a refrigerant outlet port of the evaporator, are formed;

a valve body which is disposed in said valve housing to sit freely on and to separate from the valve seat;

valve body urging means for urging said valve body toward the valve seat in said valve housing;

a power element which is disposed adjacent to said valve housing and which has a diaphragm partitioning an inner space of said power element into a heat sensitive working chamber and a refrigerant vapor working chamber, the heat sensitive working chamber holding heat sensitive working fluid in a sealed manner and the refrigerant vapor working chamber being independent of the heat sensitive working chamber and communicating with the second refrigerant passage;

a valve body drive member which is fixed to the center of the diaphragm of said power element and which is exposed to the second refrigerant passage, wherein the valve body drive member has a blind hole opened to the heat sensitive working chamber of said power element, and wherein the valve body drive member transmits a deflection of the diaphragm to said valve body to make said valve body sit on and separate from the valve seat; and a heat ballast which is contained in the blind hole of said valve body drive member and which retards at least the rate of gas pressure rise of the heat sensitive working fluid in the heat sensitive working chamber, caused by a temperature rise of refrigerant vapor flowing in the second refrigerant passage at the refrigerant outlet port of the evaporator;

wherein:

a central opening for receiving an end portion of said valve body drive member is formed in a center of the diaphragm;

an inner peripheral portion of the diaphragm surrounding the central opening forms a tubular projection which extends toward an end of an end portion along an outer peripheral surface of the end portion of said valve body drive member inserted into the central opening of the diaphragm;

an annular diaphragm catch is fitted on an outer peripheral surface of the tubular projection of the diaphragm; and a projecting end of the tubular projection of the diaphragm, the end of the end portion of said valve body drive member and an end surface of said diaphragm catch at the side of the projecting end of the tubular projection of the diaphragm are airtightly welded together.

2. A thermal expansion valve according to claim 1, wherein a diaphragm support member is disposed on the outer peripheral surface of the end portion of said valve body drive member close to the diaphragm and a base end portion of the tubular projection of the diaphragm is stacked on the diaphragm support member and is supported by the support member.

3. A thermal expansion valve according to claim 1, wherein said heat ballast is particulate active carbon which retards not only the rate of gas pressure rise of the heat sensitive working fluid in the heat sensitive working chamber caused by the temperature rise of the refrigerant at the refrigerant outlet port of the evaporator in the second refrigerant passage but also the rate of gas pressure fall of the heat sensitive working fluid in the heat sensitive working chamber caused by a temperature fall of the refrigerant at the refrigerant outlet port of the evaporator in the second refrigerant passage.

4. A thermal expansion valve according to claim 3, wherein the heat sensitive working fluid is $CF_4$ (tetrafluoromethane), or $CF_3$-$CH_2F$ (1,1,1,2-tetrafluoroethane).

5. A thermal expansion valve according to claim 1, wherein said heat ballast is sintered alumina silica which retards the rate of transition of the heat sensitive working fluid entered in fine pores of said heat ballast from a liquid phase to a gas phase during the temperature rise of the refrigerant at the refrigerant outlet port of the evaporator in the second refrigerant passage, and which does not hinder rapid transition of the heat sensitive working fluid from the gas phase to the liquid phase in the heat sensitive working chamber and the blind hole during a temperature fall of the refrigerant at the outlet port of the evaporator in the second refrigerant passage.

6. A thermal expansion valve according to claim 5, wherein the heat sensitive working fluid is $CF_3—CH_2F$ (1,1,1,2- tetrafluoroethane).

* * * * *

UNITED STATES PATENT AND TRADEMARK OFFICE

CERTIFICATE OF CORRECTION

PATENT NO. : 5,297,728

DATED : March 29, 1994

INVENTOR(S) : Masamichi Yano et al

It is certified that error appears in the above-identified patent and that said Letters Patent is hereby corrected as shown below:

Column 6, line 42, change "...(1,1,2-..." to --(1,1,1,2-...--.

Column 6, line 43, change "...)." to --...),--.

Signed and Sealed this

Twenty-seventh Day of September, 1994

*Attest:*

Bruce Lehman

BRUCE LEHMAN

*Attesting Officer*

*Commissioner of Patents and Trademarks*